US005967519A

United States Patent [19]

Cumberland et al.

[11] Patent Number: 5,967,519

[45] Date of Patent: Oct. 19, 1999

[54] PORTABLE STEP/CURB BALL GAME

[75] Inventors: Bernard Wayne Cumberland, 7612 Cedar Rd., Baltimore, Md. 21222; Richard W. Holmes; Richard Patti, both of Baltimore, Md.

[73] Assignee: Bernard Wayne Cumberland, Baltimore, Md.

[21] Appl. No.: 09/061,131

[22] Filed: Apr. 16, 1998

[51] Int. Cl.[6] ..... A63B 67/00

[52] U.S. Cl. ..... 273/317.6; 273/396

[58] Field of Search ..... 273/348, 395, 273/396, 317.6; 473/479

[56] References Cited

U.S. PATENT DOCUMENTS

| | | | |
|---|---|---|---|
| 4,109,910 | 8/1978 | Gleason | 473/479 |
| 4,133,531 | 1/1979 | Arteaga | 273/395 |
| 5,407,210 | 4/1995 | Canning | 273/348 |
| 5,524,900 | 6/1996 | Allen | 273/396 |
| 5,531,449 | 7/1996 | Denton | 273/348 |

*Primary Examiner*—William H. Grieb

[57] ABSTRACT

A device to enable people to play the sports game of step/curb ball at virtually any site (location). The unit is designed to be filled with water to impart mass, density and stability so that resilient (rubber, tennis, ect.). Balls thrown (pitched) at it will be reflected onto the field of play at high velocities and long distances-creating a multitude of Baseball-like situations ranging from "strike-outs" to "grand-slam home runs". This portable set of steps will have a removable, netted backstop to prevent errantly-thrown and/or deflected balls from travelling behind the unit into foul territory. Retractable foul lines will emanate from the base unit, by means of spool mechanisms affixed to each of two (2) molded angular projections positioned at each front-side of the base unit just above ground level. When these foul lines are unwound from their spool mechanisms, they will automatically form the prescribed boundaries/dimensions of the Baseball-like playing field. The unit will also have pre-molded features such as handles to easily transport the game, port holes to conveniently enable the unit to be filled with and emptied of water, four feet composed of molded nubs to protect and further stabilize the base of the unit. Moreover, the backstop netting will have an integral pouch located in its approximate center to create additional game situations.

3 Claims, 17 Drawing Sheets

Figure 1:
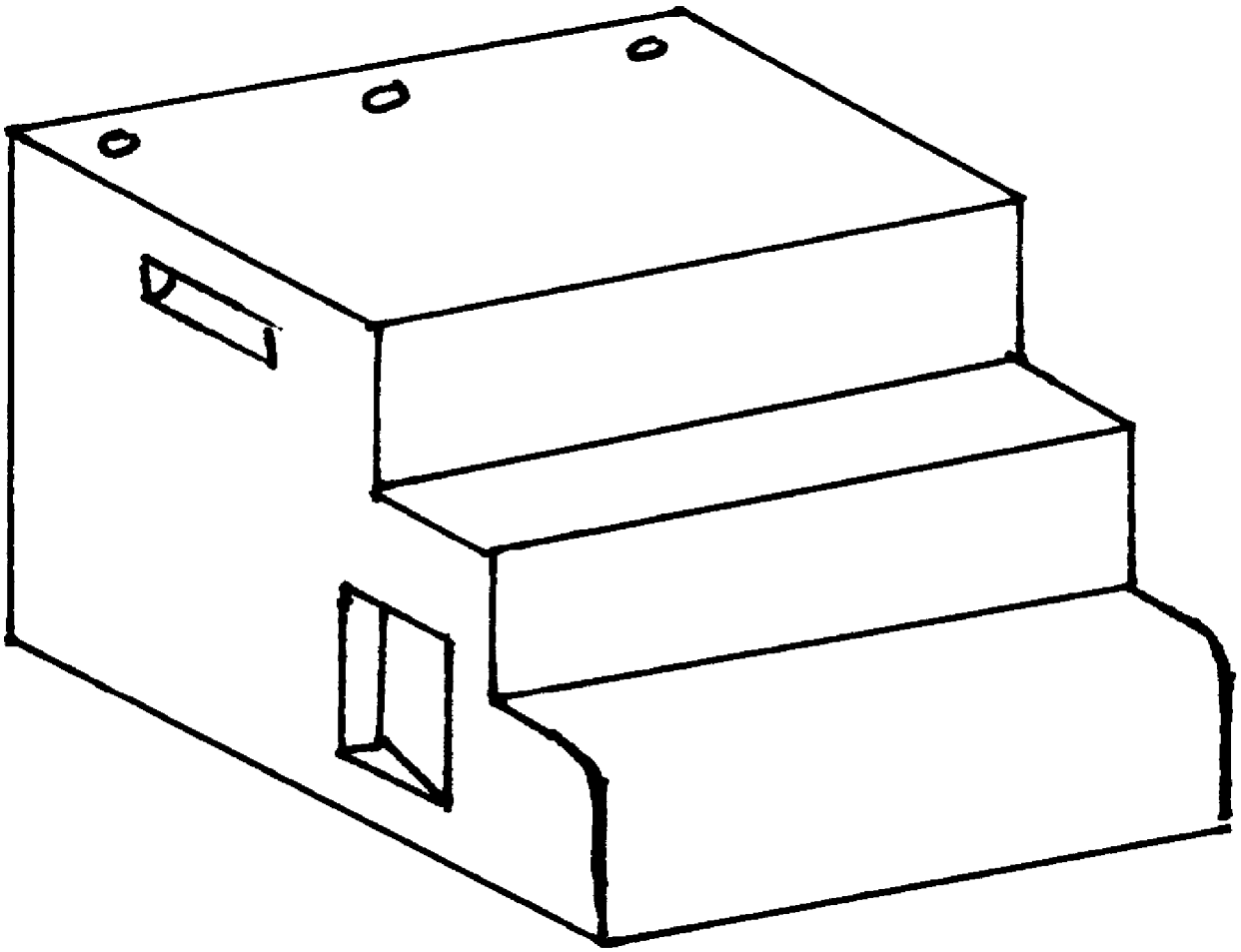
Figure 7:
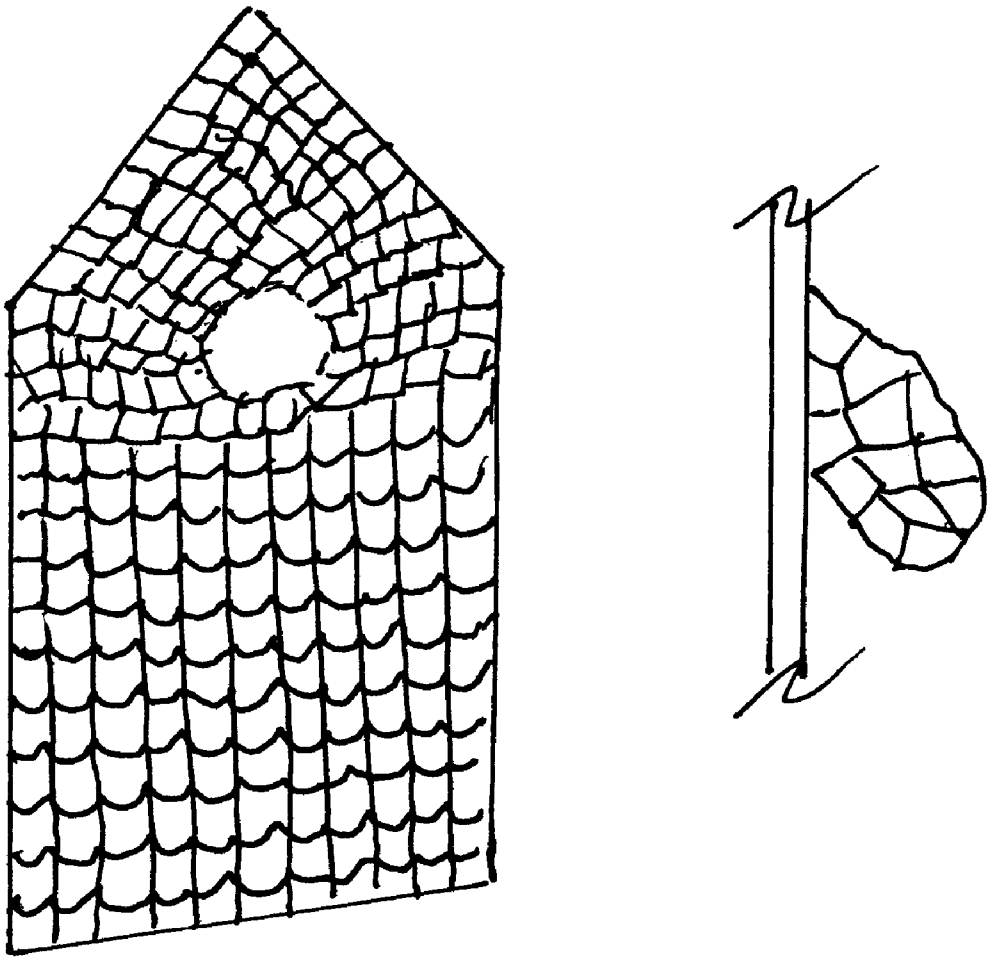
Figure 7A:
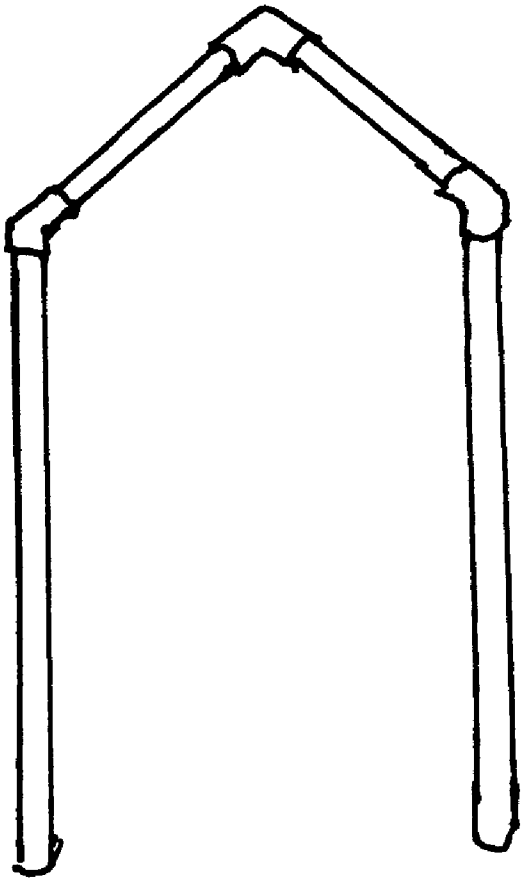

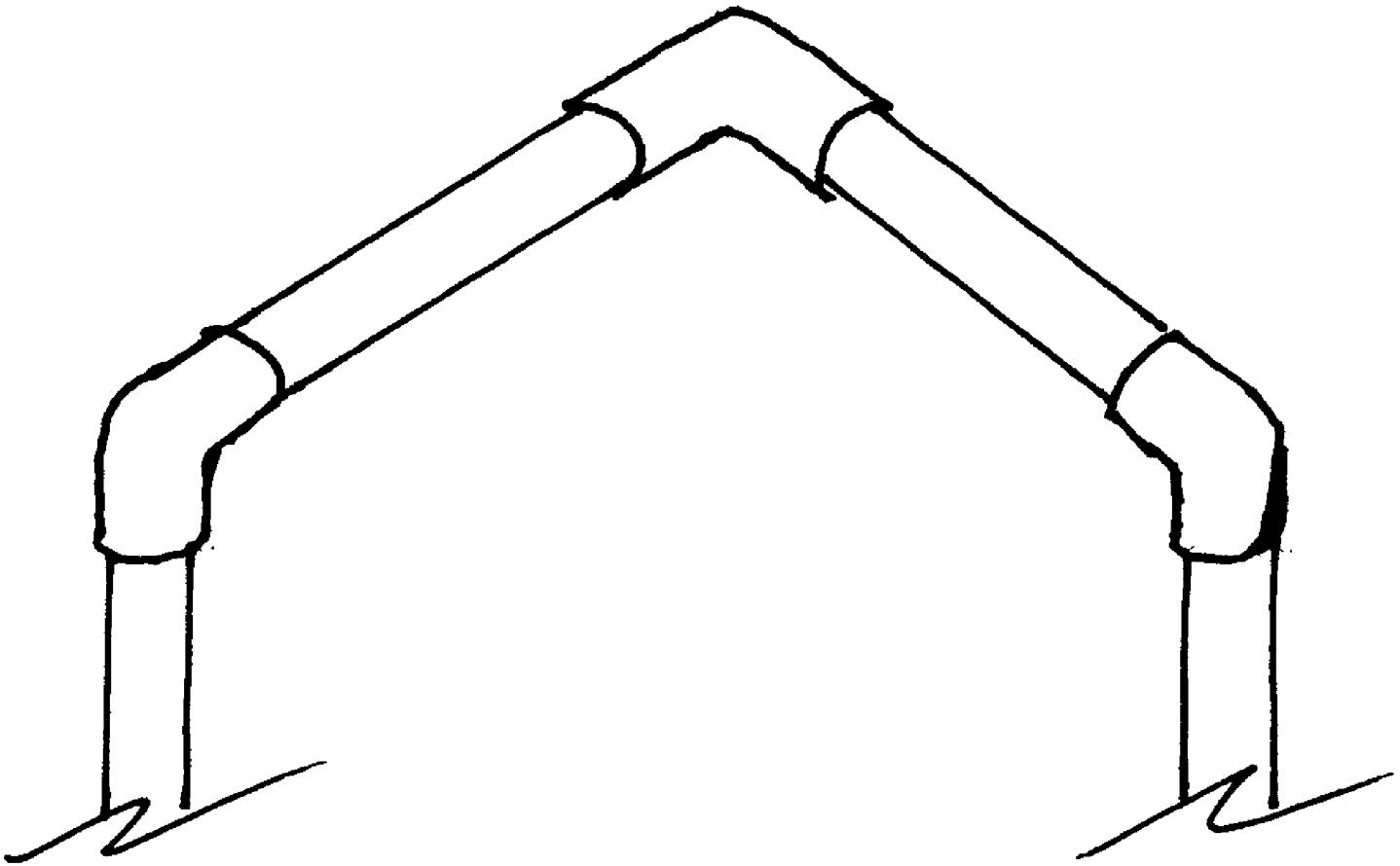
FIGURE 7A1

Figure 2:
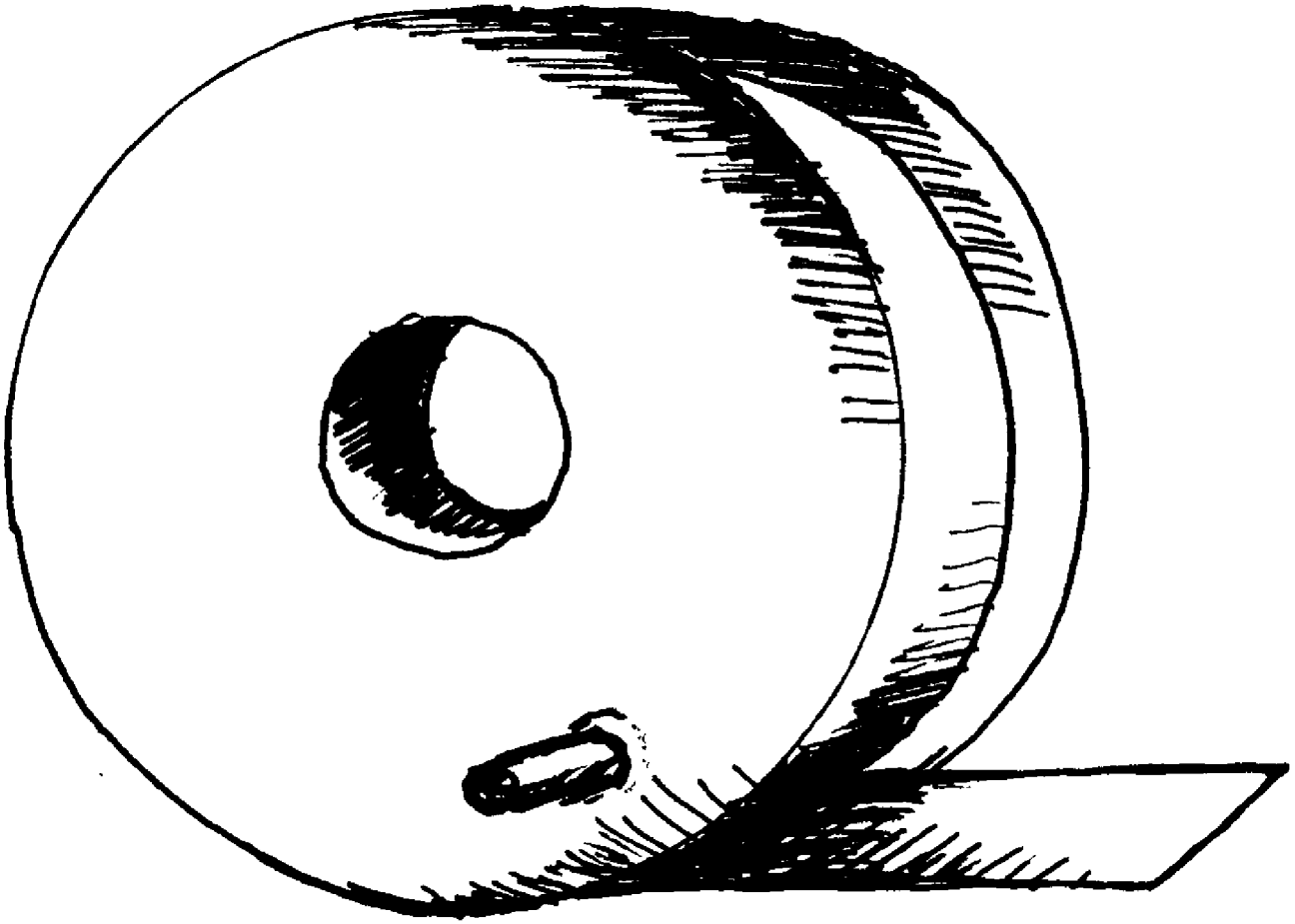
Figure 2A:
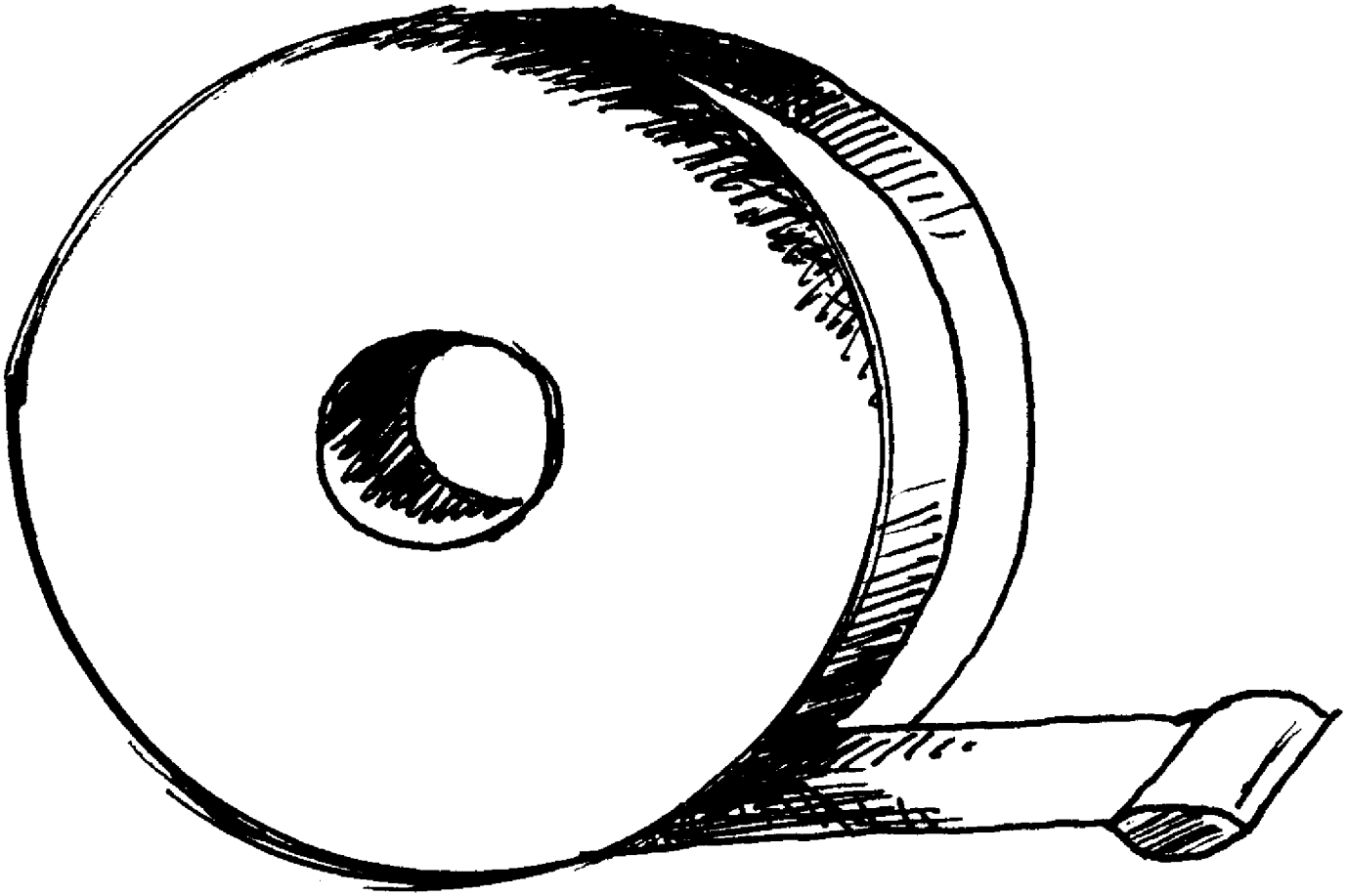

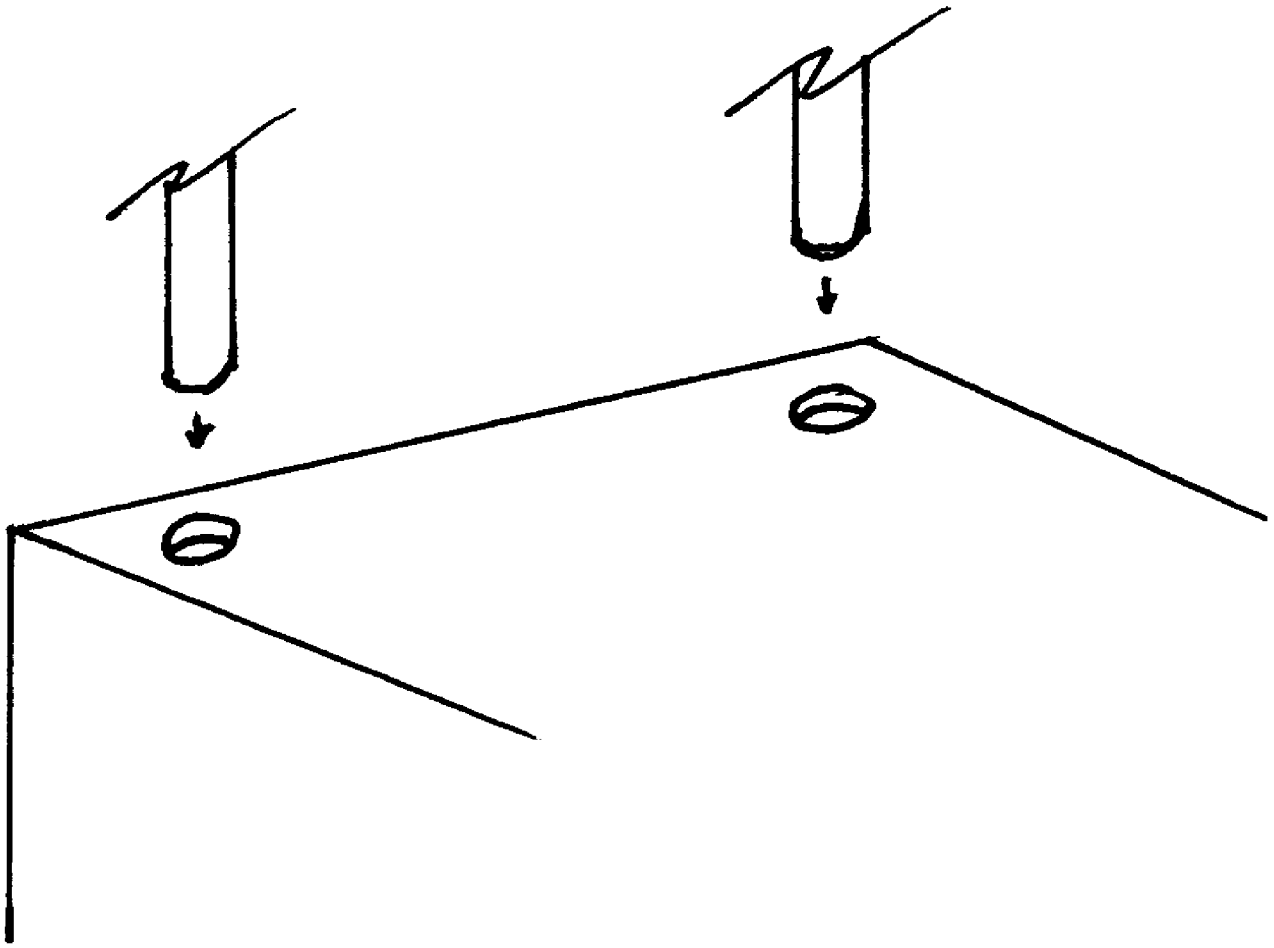
FIGURE 7A2

PORTABLE STEP/CURB BALL GAME

BACKGROUND—FIELD OF INVENTION

This invention relates to sports, specifically to the game of Baseball—without the use of bats, gloves, hardballs, bases, Baseball fields, etc. necessitated by the full and complete game of Baseball.

CROSS REFERENCES TO RELATED APPLICATIONS

Not Applicable.

OBJECTS AND ADVANTAGES

Accordingly, several objects and advantages of our invention are

1. "PORTABLE STEP/CURB BALL" is being suggested because it would fulfill the need for a portable, easy-to-set up-and-use product that would provide a convenient, safe, inoculous and unobtrusive environment in which to play this unique and exciting game;
2. To provide "clean", competitive fun and entertainment for children, teenagers and adults;
3. To provide a "Stadium"that could be set up virtually anywhere and used to play step or curb ball (this would be appealing because players could set the game up in various physical areas and play whenever they desire to);
4. To provide enjoyable, aerobic exercise-indoors or outdoors-without monotony or drudgery;
5. To provide an alternative game to be utilized in public, private, educational and recreational facilities;
6. To provide a setting and means by which fathers, sons, and daughters can spend quality time together;
7. To allow middle-aged and senior persons the opportunity to "be a kid again";

OBJECTS AND ADVANTAGES DESCRIPTION

Still further objects and advantages will become apparent from a consideration of the ensuing description and accompanying drawings.

DRAWING FIGURES

FIG. 1 BASE UNIT.

Figure 1A:
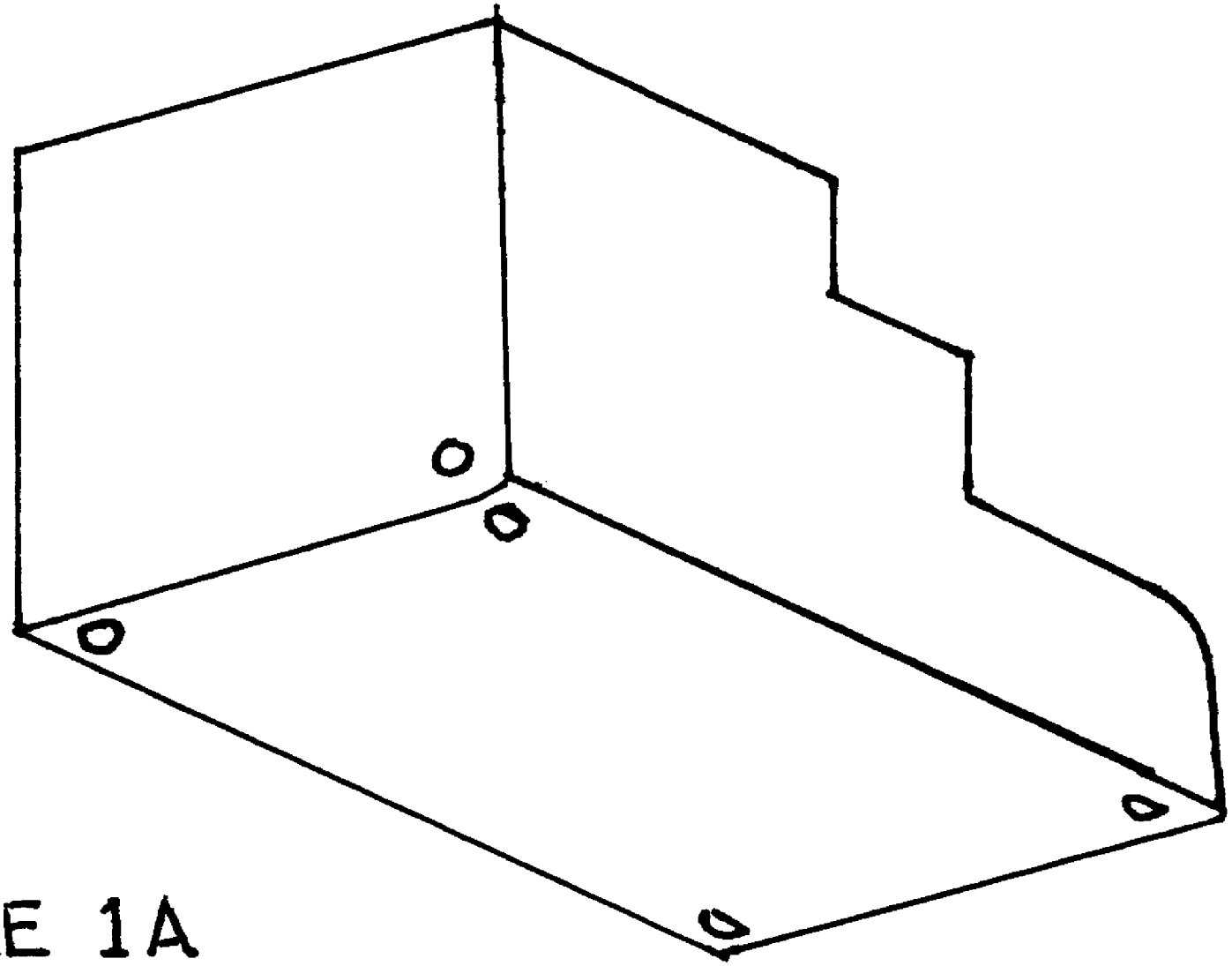
Figure 1B:
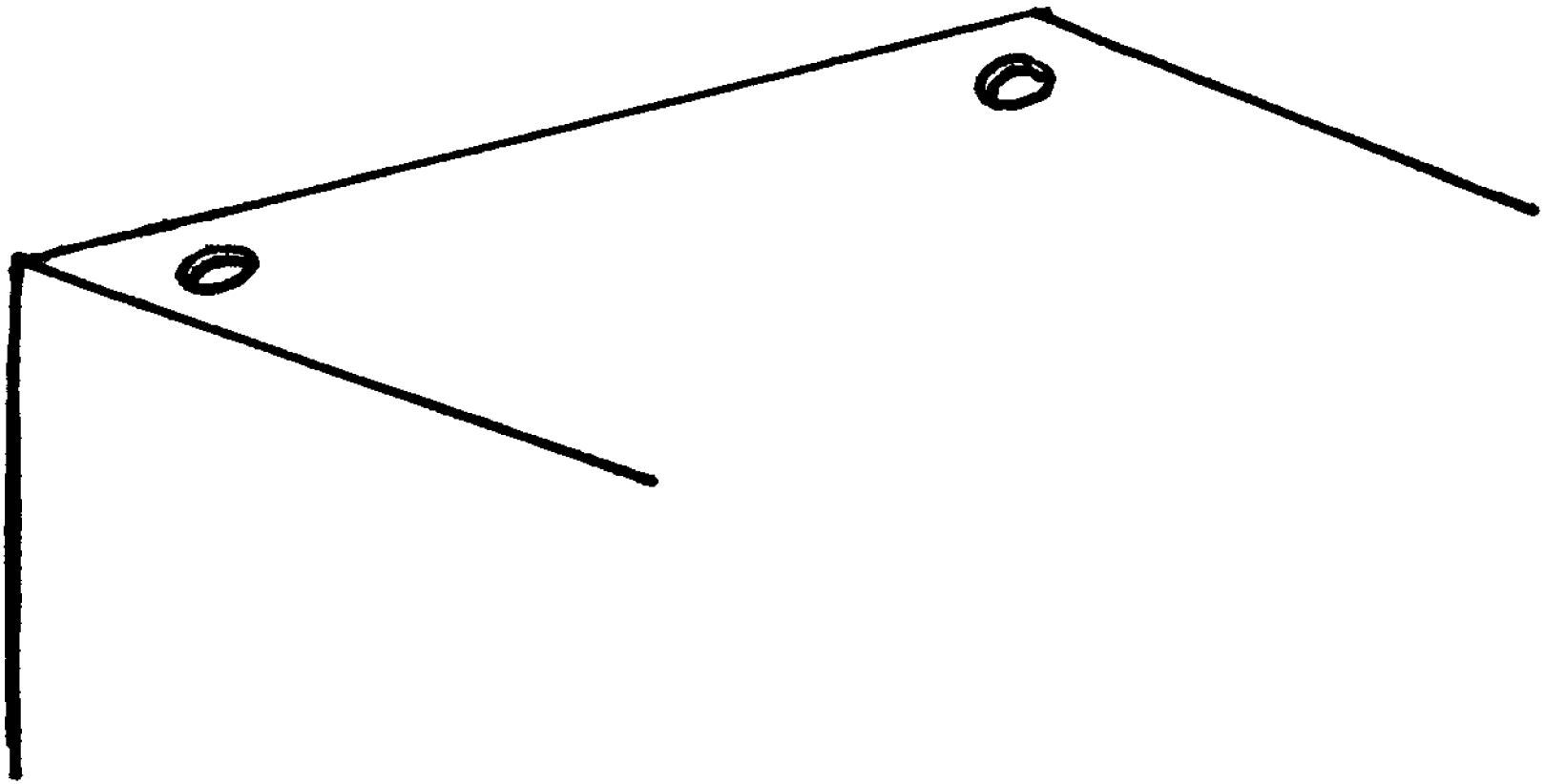
Figure 1C:
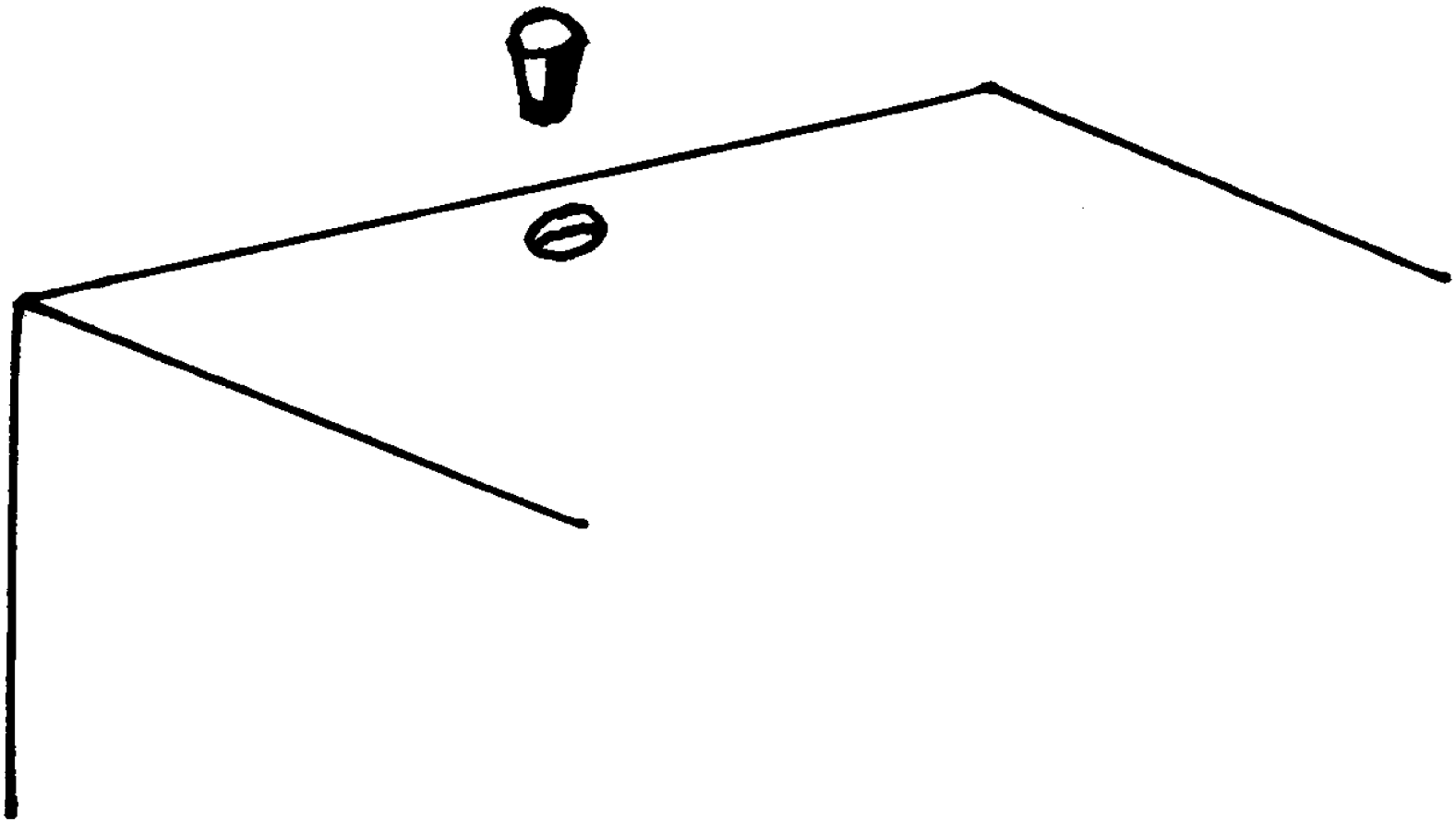
Figure 1D:
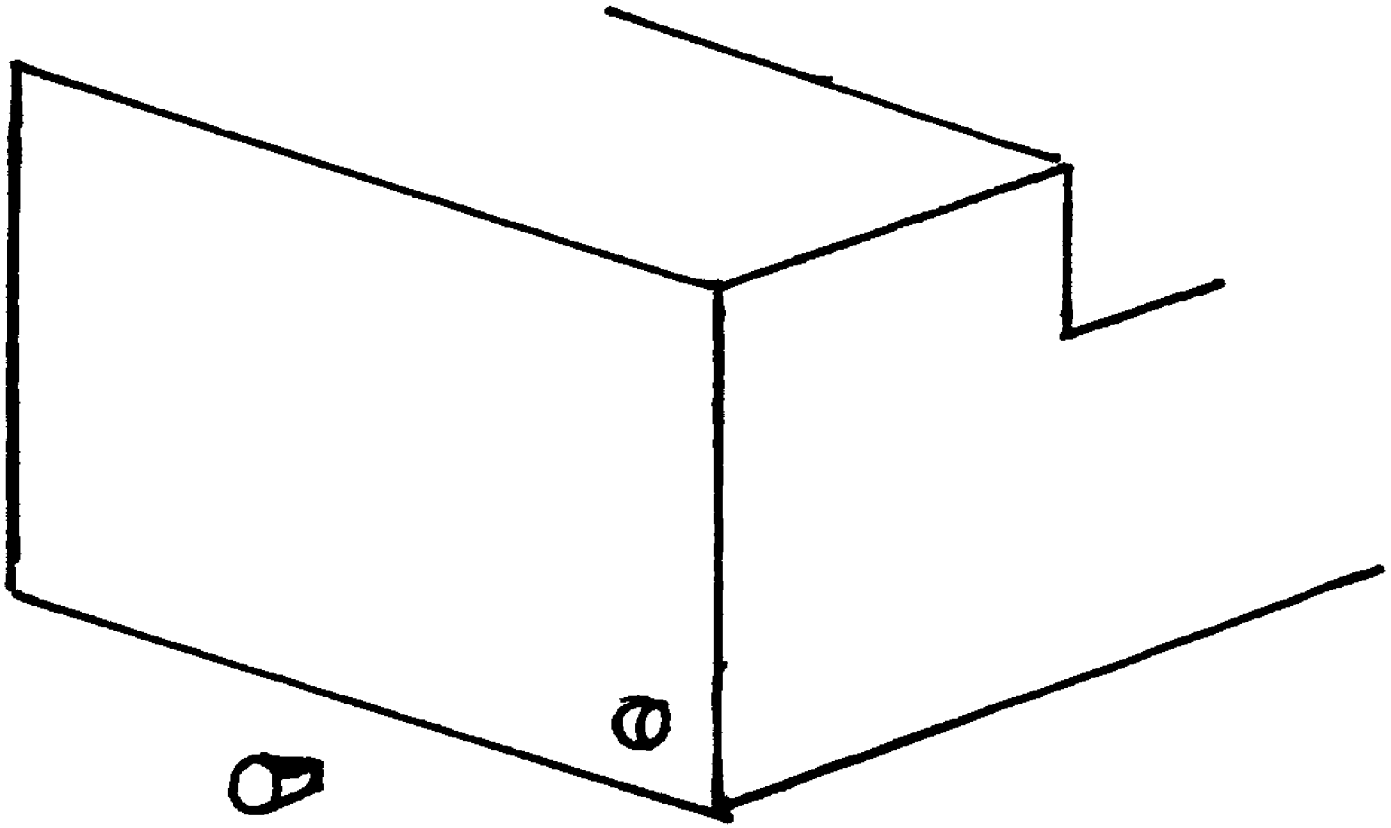

FIG. 1*a* UNDERSIDE OF BASE UNIT WITH NUBS.

FIG. 1.*b*. UPPER-MOST TREAD WITH PORT HOLES (BackStop).

FIG. 1.*c*. TOP TREAD SHOWING PORT HOLE FOR ADDING FLUID (Water).

FIG. 1.*d*. REAR OF BASE SHOWING DRAIN HOLE AND CAP (at bottom).

FIG. 2 FOUL LINES ON SPOOL.

FIG. 2.*a*. FOUL LINE WEIGHTS.

FIG. 3 FOUL LINE ANGULAR GUIDES.

FIG. 4 SPOOL GUIDES/HOLDERS.

FIG. 5 SPOOL ITSELF WITH HANDLE.

FIG. 6 MOLDED INDENTATIONS CARRYING HANDLES.

FIG. 7 BACKSTOP FRAME ASSEMBLY AND NET (complete).

FIG. 7.*a*. BACKSTOP FRAME.

FIG. 7.*a*.1. FRAME SHOWING ELBOW CONNECTORS.

FIG. 7.*a*.2. BACKSTOP INSERTING INTO UPPER TREAD.

FIG. 7.*b*. NETTING AND POUCH ONTO FRAME ASSEMBLY.

FIG. 8 EYELET-FOR INDIVIDUAL PLAY.

FIG. 9 SCORECARD WITH CLIPS ATTACHED TO BACKSTOP FRAME.

SPECIFICATION

"PORTABLE STEP/CURB BALL GAME

Base Unit (1) The base of our unit is composed of a rigid, light durable material, e.g., acrylic/PVC, etc., molded into the configuration of a traditional set of stair-steps This molded set-of-steps must be manufactured such that it is impermeable to the passage of water-which said base unit will be filled with, in order to impart mass, density and resistance to movement. For portability purposes, said unit should be filled (with water) immediately prior to each "game", and emptied thereafter.

This base will be of a predetermined width, depth and height, so that it is easily and safely transported to and from each desired playing location (field).

The height of each stair "riser" shall be equal to the depth of each stair "tread". The top of said base unit (which is the uppermost "tread") shall be approximately twice the depth of the regular treads below it.

To add the dimension of strictly "CURB-BALL", our embodiment will incorporate a "partial step" midway between the lower step [stair] tread and ground level, whose dimensions of "tread" and "riser" shall be ½ those of the regular stair steps. Further, to simulate the traditionally "rounded"/curved/non-sharp edge of a typical concrete curb, the longitudinal edge of this "partial step" (curb) shall be rounded. This added dimension of our embodiment will enable "Curb-Ball" to be played which will greatly aid those players who may be less skilled at striking the thrown ball against the sharp, pointed, 90 degree edge of the regular stair steps.

This added dimension of the CURB will also increase the total, interior volume of our unit-with the resultant increase in the total mass/density of the unit when filled with water.

a. The underside of said base unit shall have molded into it (at each of its four [4] corners) nubs/feet for the purpose of both protecting the underside from scuffing/wear-and-tear, and further anchoring said base unit to the playing surface (see FIG. 1.*a*.).

b. The uppermost "tread" (top) shall have-at its two (2) rear corners-port holes for the insertion of the framing ends of the invention's "back-stop" (see FIG. 1.*b*.).

c. At the rear center of the uppermost "tread" (base unit's top) shall be a port hole for the purpose of introducing water to the base unit's interior cavity, together with a corresponding removable plug/cap. The [filler] hole shall be of sufficient diameter to enable the unit to be filled with water by means of a garden hose-if convenient (see FIG. 1.*c*.).

d. The base unit's rear (back) shall have at its lower left or right corner a port hole (outlet) for the purpose of draining filled unit-together with a corresponding plug to contain the water within the unit (see FIG. 1.*d*.).

Figure 3:
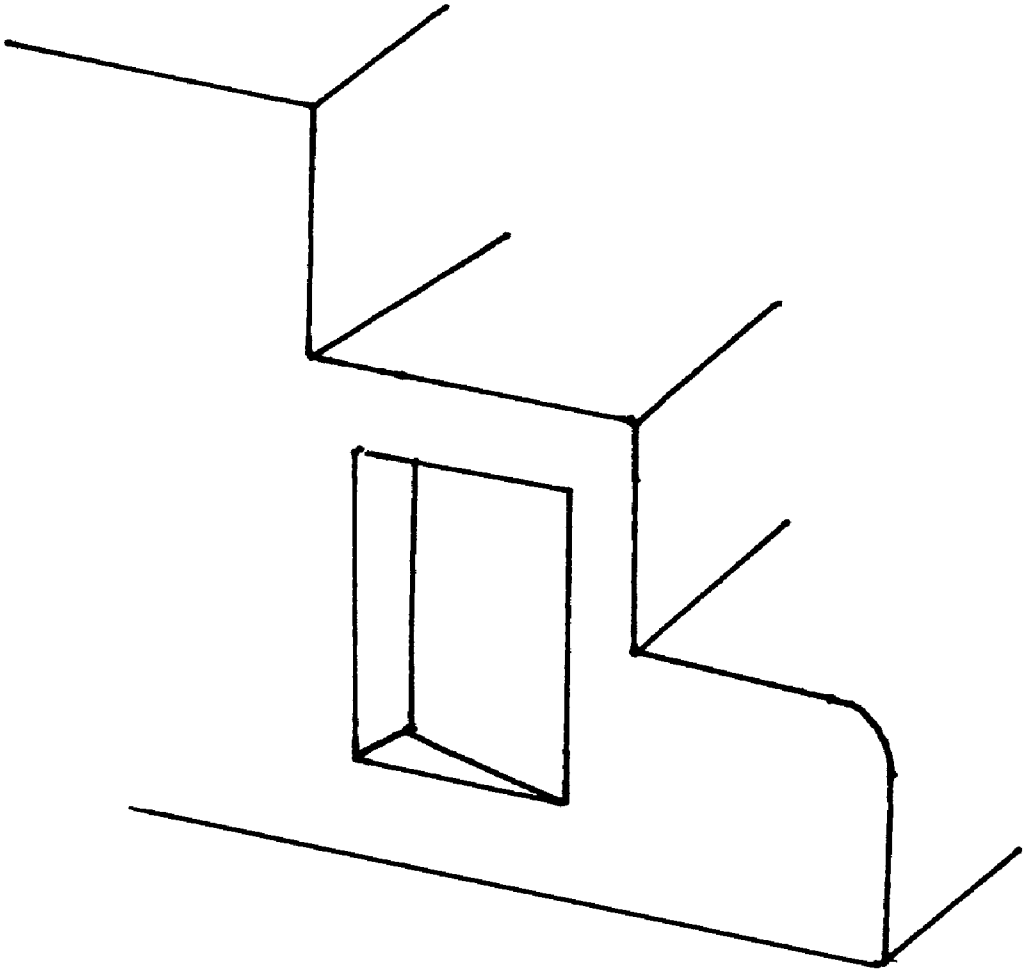
Figure 4:
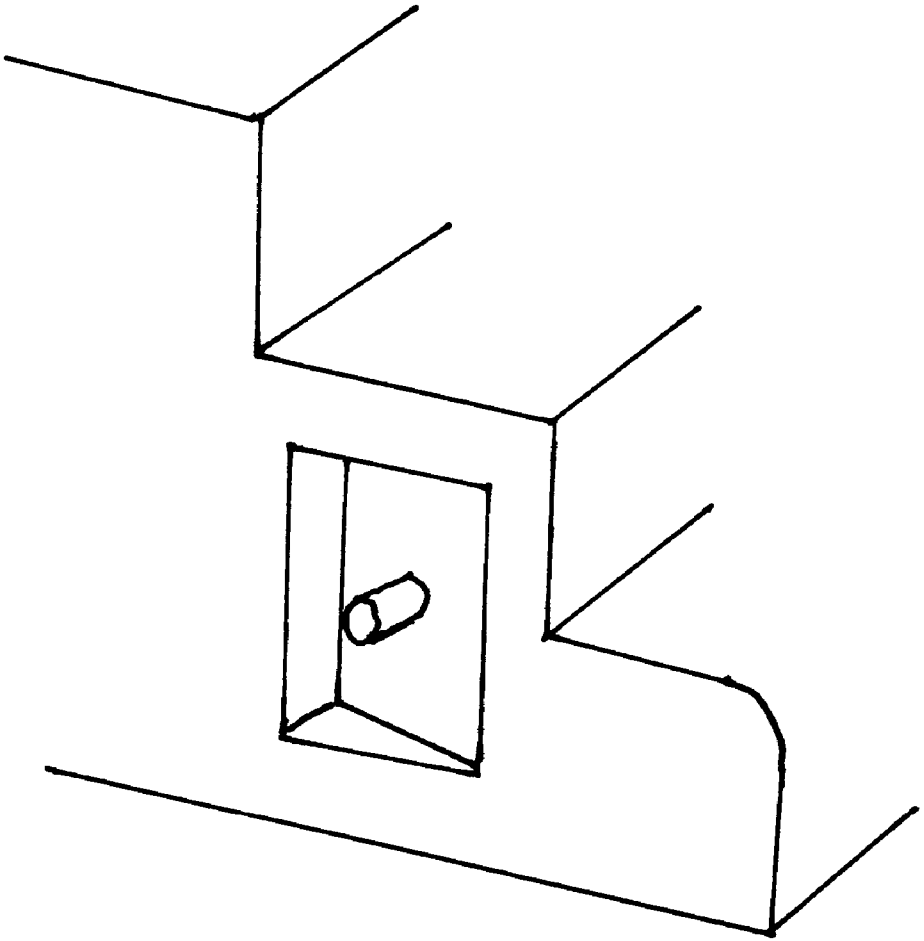
Figure 5:
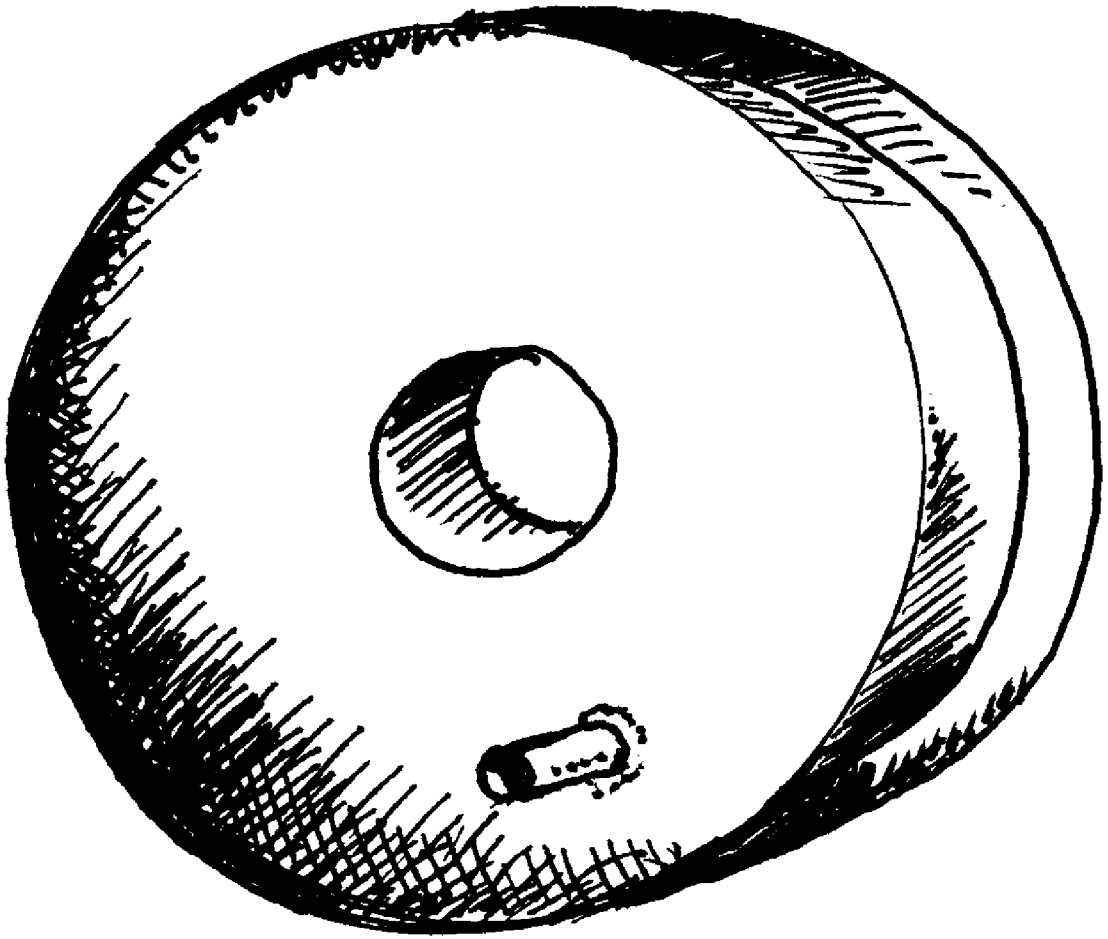
Figure 6:
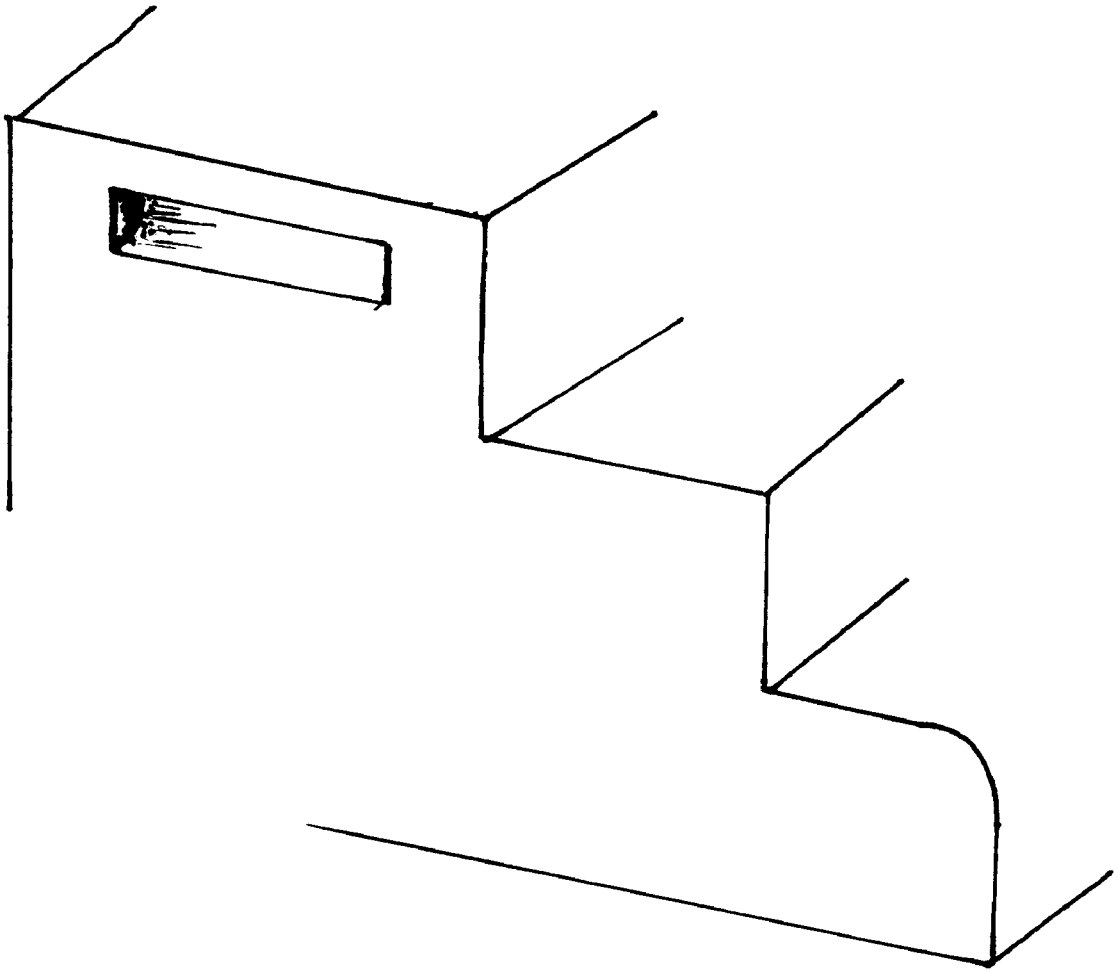

(2) The following, additional embodiments of our overall invention shall protrude from and/or be encased within the above-described base unit (as viewed from the bottom upward)

a. FOUL LINES; a retractable [BASEBALL-like] foul line on each side of the base unit's bottom (base) step. A spring-like coiled mechanism or winding spool shall be employed to automatically and rapidly re-wind the extended foul lines at the conclusion of each game. The foul lines themselves shall be of a durable, water-resistant, brightly-colored material selected from the group consisting of string, construction marking tape, etc. The lenght of each of the two (2) foul lines [right and left] shall be identical to the hypotenuse of an imaginary right triangle whose longest line segment shall be the actual lenght (distance) of an experimentally-determined "average" Home Run to straightaway Center Field, (or alternatively, the imaginary line which runs from the center of "home plate" [the base unit] to the center of the existing playing field's "Home Run barrier" [fence, wall, etc.]. These foul lines (string, construction-marking tape, etc.) shall be anchored at its outfield termini by means of a small, compact, dense weight permanently attached thereto. Furthermore, each said foul line will be able to be pulled out from its spool at each side of the bottom step-such that when it is fully extented/withdrawn, the point at which it [foul line] touches the "Home-Run Barrier" shall be the resultant, properly-positioned, left-and right-field foul (poles), respectively. The two (2) outfield termini of these foul lines shall be fixed in said positions by means of a bean-bag/sand-bag type of weight affixed thereto (see FIG. 2.*a*.).

b. ANGULAR FOUL LINES'GUIDES; integrally-molded "angles" positioned at each side of the base unit-just above ground level-at the fronts (of the bottom sides) such that when said foul lines are unwound from their spool mechanisms, they "automatically" emanate at the prescribed angle with respect to the longitudinal [imaginary] axis of the base unit forming the optimum boundaries of the playing field. As mentioned above in "integrally, these embodiments are not separate entities attached to the sides of the base unit, but rather are formed as part of the base unit during the molding/manufacturing process (see FIG. 3.).

c. FOUL LINES'SPOOL MECHANISMS'HOLDERS; stud-like spindles which are molded into and protrude from the "ANGULAR FOUL LINES GUIDES" described above. This embodiment will serve to hold or contain the said spool mechanisms in such a way that said foul lines can be wound and unwound freely for game playing (see FIG. 4.).

d. FOUL LINES'SPOOL MECHANISMS; plastic-like spools around which are wound the said foul lines by means of winding with a rotating handle (similar to that of a standard fly-fishing reel) (see FIG. 5.).

e. CARRYING HANDLES; molded indentations near the top of each side of the base unit, to facilitate the transport of the game/invention from site to site, i.e., "stadium" to "stadium". (see FIG. 6.)

(3) BACKSTOP ASSEMBLY a. BACKSTOP FRAME; a lightweight, smooth, structurally-rigid material (e.g., PVC piping) fashioned into the shape of an elongated, inverted, Home Plate. (See FIG. 7.*a*.) The connections among the several parts of this depicted frame will be made by means of standard plumbing-like connectors, such as PVC elbow fittings (one [1] 90 degrees and two [2] of 45 degrees) (see FIG. 7.*a*.1.)

This frame will be attached to the rear of the top "stair tread" of the base unit by means of inserting its frame ends/legs into the two (2) port holes described in section "1.b." above. (See FIG. 7.*a*.2.)

b. BACKSTOP NETTING; this element is composed of a combination of braided, interwoven, cross-diagonal netting of a string-like material, e.g., nylon. This netting assembly is attached to said backstop framework along its perimeter by mans of such fastening devices as braided loops, velcro strapping, etc. Incorporated into this netting assembly is an integral pouch located in the central portion of said netting and will be of a predetermined diameter and depth (See FIG. 7*b*)

Operational Description

Our heretofore-described (in the Static Description/Specification) invention enables one to play a Baseball-like game without necessitating the use of baseball bats, hardballs, gloves, large recreational playing fields, and other Baseball paraphernalia.

It operates in the following way: one throws a resilient ball (tennis/pinky/sponge-etc.) against the front portion (step-facing) of the BASE UNIT [see FIG. 1 of Specifications and Drawings]. The thrown ball then, upon striking the "steps" or "curb" becomes "in play", resulting in a potential multitude of Baseball-like "situations"-ranging from a "strike-out" to a "grand-slam home run" (all of these possible "situations" will be enumerated and defined in our separate, copyrighted Rules and Regulations). The primary objective of the game is to consistently throw/pitch the ball in such a way that it "reflects" from the steps/curb [of the Base Unit] into the "field-of-play", to generate "hits", and consequent "runs" (all this is the Offensive strategy objective). Conversely, the pitched balls could be deflected from the steps into "foul territory" or into the backstop netting, to result in foul balls/strikes/strike-outs/foul-outs or "Automatic Outs", respectively (see FIG. 7).

The above Field-of-Play shall be delineated on its left and right sides by means of the extented (withdrawn) Foul Lines (see FIG. 2) which will unwind at the predescribed angles (approximately 30 degrees) with respect to the anchored (weighted) Base Unit. Furthermore, the most distant [from the Base Unit] boundary of the Field-of-Play will be what we name/call the "Home-Run Barrier". This [Home-Run-Barrier] shall be ANY existing, stationary fence, brick-or-block wall, hedge, tennis court net, etc.,etc. Having the capability to position this Base Unit at a predescribed distance from said ubiquitous Home-Run-Barriers means that "stadiums" for playing this game are virtually unlimited in number and location.

The players fill the base unit with water, and then cap it (see FIG. 1.*c*.). This imparts mass/weight to the Base Unit-much greater then its own manufactured weight-so that the pitched ball reflects/deflects from the struck steps with much greater velocity and distance.

Viewed from an aerial perspective, the configuration of our STEP/CURB BALL field-of-play (both "fair" and "foul") is that of a standard Baseball diamond's playing field.

The portability of our invention enables one to safely and easily set-up and play a rendition of the traditional game of Baseball at virtually any location that one desires.

Our separate, copyrighted Rules and Regulations will define, describe and "rule on" every possible play-situation which results from a pitched ball striking the steps [Base Unit].

The game is to be played, ideally, using one-to-three offensive players (the "batters"), and one-to-three defensive players (the "fielders").

The overall, created (set-up), physical demensions of the (each) playing field can be totally varied to accommodate any and all types of players ranging from young children to the strongest of adults.

Figure 8:
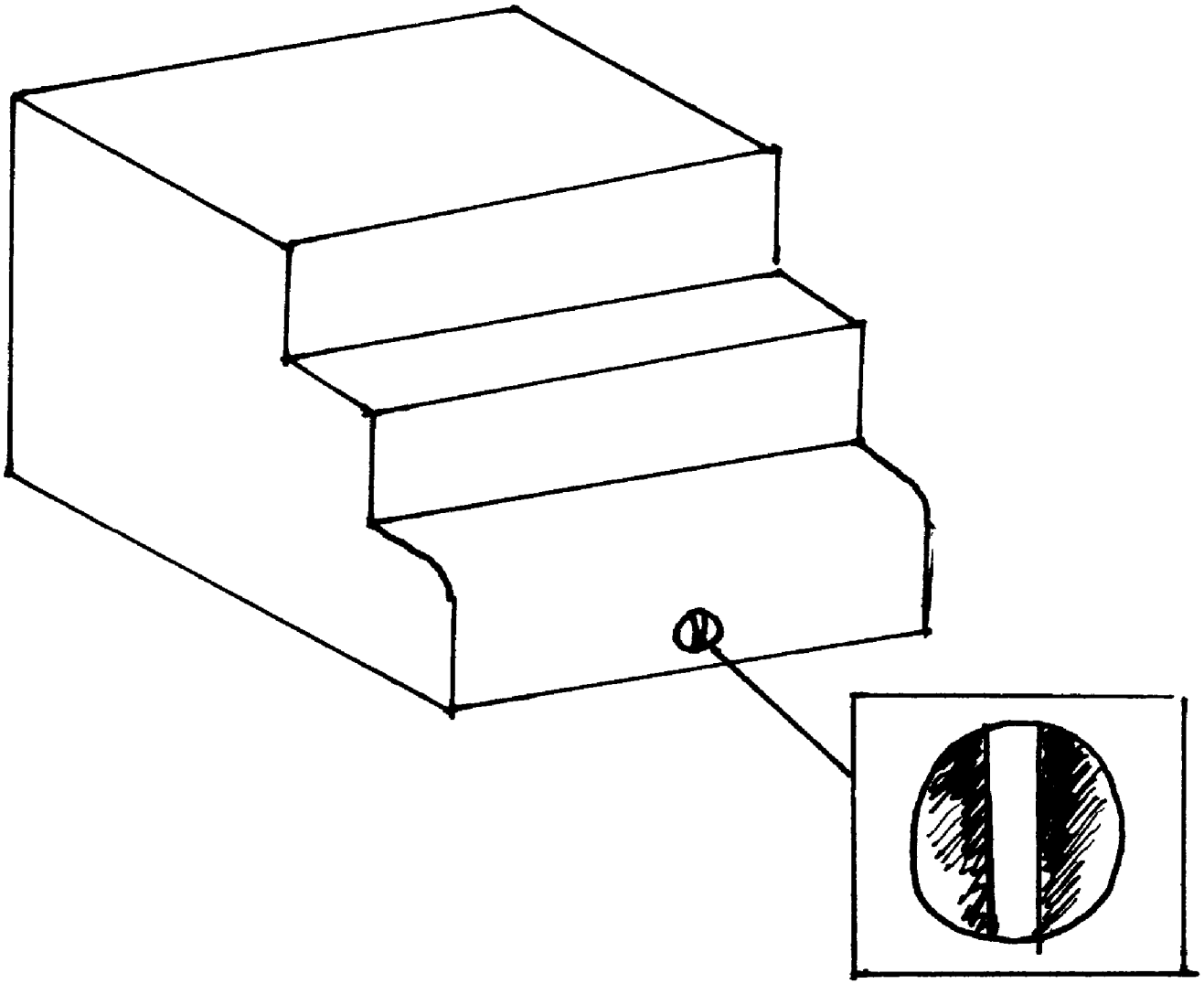

Alternative Embodiments (1) A further embodiment of our invention is a means for an individual to practice hitting and fielding-solo-by use of the following element: an integrally-molded eyelet located in the front-center of the bottom "riser" (see FIG. 8.). A bungee-type cord is attached to the Base Unit's eyelet at one end, and to a "practice" ball at the other end. This arrangement enables on to become proficient in the arts of hitting and fielding simultaneously.

Figure 9:
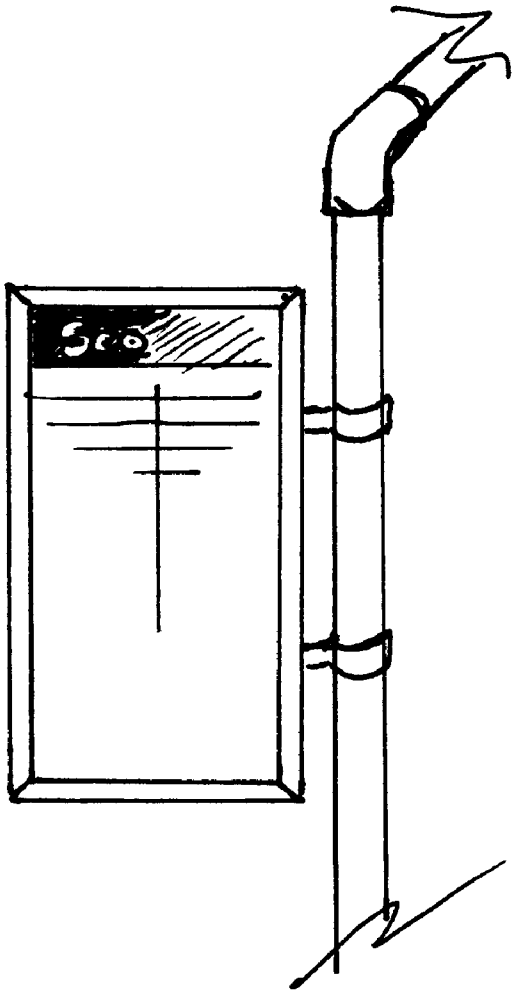

(2) Clip-On Score Card: a standard scoring card similar to that used in traditional Baseball. This score-card holder will have affixed to it two (2) clips for easy and quick attachment to and removal from the Backstop frame (see FIG. 9.).

(3) A custom-made Step/Curb-Ball coin, which will be tossed/flipped at the beginning of each game, to determine which team shall have "home-field advantage".

(4) A catching glove (similar to a Baseball-batting glove) with a hook-Velcro palm-to assist players who are relatively unskilled at the art of fielding.

CONCLUSION, RAMIFICATIONS, AND SCOPE OF INVENTION

Thus the reader will see that our invention of the "Portable Step/Curb Ball Game" provides a totally-portable, yet stable, sports-game device that can be used by people of almost any age to play the aerobic, fun-filled, nostalgic game of Step/Curb Ball, virtually anywhere. Although completely portable, when "set-up" for game play, a stadium-like setting is created. Although our above, detailed descriptions-both static and operational-contain much very specific data, they should not be interpreted as parameters or limitations on the SCOPE of our invention, but rather as the exemplification of the preferred embodiment thereof. A number of other variations of this basic invention are possible. For example, it can be adapted to play in swimming pools, ocean, etc. Also, it can be used to play Tee-ball. Also, it can be used as a pitching target to hone throwing accuracy. Consequently, the actual scope of our invention should be determined not by the embodiment described and illustrated, but rather by the accompanying claims and their legal equivalents.

We claim:

1. A portable step/curb ball game-playing device comprising:

a base unit of predetermined dimensions simulating a standard set of stair steps used as a means for deflecting a thrown ball to create baseball-like situations;

a backstop attached thereto, whereby deflected balls are prevented from travelling behind said base unit; and a pair of foul line members attached to and extending from each side of the base unit.

2. The device of claim 1, further comprising:

a drain hole in the base unit for permitting the base unit to be filled with water and emptied, and a plug to contain the water in the unit.

3. The device of claim 1, further comprising;

a partial step approximately one-half the size of a standard step, and having a rounded edge.

* * * * *